US008766750B2

(12) United States Patent
Choi

(10) Patent No.: US 8,766,750 B2
(45) Date of Patent: Jul. 1, 2014

(54) ELECTROMAGNETIC SWITCHING APPARATUS

(75) Inventor: Yeon Soon Choi, Gyeongsangbuk-Do (KR)

(73) Assignee: LSIS Co., Ltd., Anyang, Gyeonggi-Do (KR)

( * ) Notice: Subject to any disclaimer, the term of this patent is extended or adjusted under 35 U.S.C. 154(b) by 0 days.

(21) Appl. No.: 13/269,506

(22) Filed: Oct. 7, 2011

(65) Prior Publication Data

US 2012/0092098 A1 Apr. 19, 2012

(30) Foreign Application Priority Data

Oct. 15, 2010 (KR) ..... 10-2010-0100877

(51) Int. Cl.
*H01H 3/00* (2006.01)
*H01H 67/02* (2006.01)

(52) U.S. Cl.
USPC ..... 335/185; 335/181

(58) Field of Classification Search
USPC ..... 335/128–134, 192–192
See application file for complete search history.

(56) References Cited

U.S. PATENT DOCUMENTS

| | | | | |
|---|---|---|---|---|
| 4,434,450 | A * | 2/1984 | Gareis | 361/152 |
| 4,893,102 | A * | 1/1990 | Bauer | 335/132 |
| 5,272,458 | A | 12/1993 | Hoffman et al. | |
| 7,064,638 | B1 * | 6/2006 | Muramatsu | 335/132 |
| 7,422,193 | B2 * | 9/2008 | Sisk et al. | 251/64 |
| 7,852,178 | B2 * | 12/2010 | Bush et al. | 335/126 |
| 7,859,373 | B2 * | 12/2010 | Yamamoto et al. | 335/126 |
| 8,248,192 | B2 * | 8/2012 | Hu et al. | 335/18 |
| 2008/0007373 | A1 | 1/2008 | Andoh et al. | |

FOREIGN PATENT DOCUMENTS

| | | |
|---|---|---|
| CN | 1161556 | 10/1997 |
| CN | 101167151 | 4/2008 |
| EP | 0798752 | 10/1997 |
| EP | 1953784 | 8/2008 |
| JP | 2-161702 | 6/1990 |
| JP | 10-135035 | 5/1998 |
| JP | 2001357767 | 12/2001 |
| JP | 2008-16281 | 1/2008 |

OTHER PUBLICATIONS

Japan Patent Office Application Serial No. 2011-226643, Office Action dated Feb. 26, 2013, 3 pages.

* cited by examiner

*Primary Examiner* — Bernard Rojas
(74) *Attorney, Agent, or Firm* — Lee, Hong, Degerman, Kang & Waimey

(57) ABSTRACT

In an electromagnetic switching apparatus, a fixed core is fixedly-installed at a lower side, and a movable core driven by an electromagnetic force is installed at an upper side so as to be directly connected to a movable contact. This may require no shaft, and thus simplify the entire structure.

13 Claims, 3 Drawing Sheets

ELECTROMAGNETIC SWITCHING APPARATUS

CROSS-REFERENCE TO RELATED APPLICATION

Pursuant to 35 U.S.C. 119(a), this application claims the benefit of earlier filing date and right of priority to Korean Patent Application No. 10-2010-0100877, filed on Oct. 15, 2010, the contents of which is hereby incorporated by reference herein in its entirety.

BACKGROUND OF THE INVENTION

1. Field of the Invention

The present invention relates to an electromagnetic switching apparatus, and more particularly, to an electromagnetic switching apparatus capable of having a simplified structure and capable of preventing the occurrence of noise.

2. Background of the Invention

An electromagnetic switching apparatus serves to supply a current to a load or to interrupt current supply to the load, by opening and closing a contact by an electromagnetic force. This electromagnetic switching apparatus is used at equipment for industry, machines, vehicles, etc.

The electromagnetic switching apparatus includes a fixed contact, a movable contact and a driving unit. As the driving unit drives the movable contact by using an electromagnetic force, the movable contact moves to contact or be separated from the fixed contact. As a result, a current is supplied to a load, or current supply to the load is interrupted.

According to the recent trend that various apparatuses have minimized sizes in all the industry fields, the electromagnetic switching apparatus is also required to have a minimized size. In order to implement an electromagnetic switching apparatus having an enhanced reliability, an impact or frictional noise occurring by motions of the driving unit of the electromagnetic switching apparatus may be prevented to the maximum.

FIG. 1 is prior art and illustrates a partial sectional view of one example of an electromagnetic switching apparatus using a shaft. The electromagnetic switching apparatus 100 of FIG. 1 comprises a fixed contact 110, a movable contact 120, a driving unit 130 and a case 140.

The fixed contact 110 includes a first fixed contact 111 connected to a power input, and a second fixed contact 112 connected to a load. For instance, the fixed contact 110 may be fixedly-installed at an upper part of the case 140.

The movable contact 120 is configured to contact or to be separated from the fixed contact 110. When the movable contact 120 contacts the fixed contact 110, the first fixed contact 111 and the second fixed contact 112 are connected to each other by the movable contact 120. Accordingly, power input through the first fixed contact 111 is supplied to a load through the second fixed contact 112.

When the movable contact 120 is separated from the fixed contact 110, the first fixed contact 111 and the second fixed contact 112 are disconnected from each other. Accordingly, power input through the first fixed contact 111 is not supplied to a load through the second fixed contact 112.

The driving unit 130 drives the movable contact 120 by using an electromagnetic force, thereby controlling the movable contact 120 to contact or to be separated from the fixed contact 110. The driving unit 130 includes a fixed core 131, a movable core 132, a shaft 133 and a coil 134.

The fixed core 131 attracts the movable core 132 by an electromagnetic force. For instance, the fixed core 131 may be fixedly-installed at a lower part of the case 140, and may be provided therein with a recess for passing a shaft 133 therethrough.

The movable core 132 is installed below the fixed core 131, and is moved by an electromagnetic force. Once an attractive force occurs between the fixed core 131 and the movable core 132 by an electromagnetic force, the movable core 132 approaches to the fixed core 131. However, once the electromagnetic force does not occur any longer, the movable core 132 is spaced from the fixed core 131 by gravity.

One side of the shaft 133 is coupled to the movable core 132, and another side thereof is coupled to the movable contact 120. Under this configuration, the shaft 133 transmits, to the movable contact 120, a driving force of the movable core 132 due to an attractive force occurring between the fixed core 131 and the movable core 132 by an electromagnetic force, thereby allowing the movable contact 120 to come in contact with the fixed contact 110.

Once the electromagnetic force does not occur any longer, the movable core 132 is spaced from the fixed core 131 by gravity. As a result, the movable contact 120 coupled to the movable core 132 is spaced from the fixed contact 110.

The coil 134 is installed near the fixed core 131 and the movable core 132, and forms a magnetic field at the periphery thereof when a current is applied thereto. By the magnetic field, a magnetic flux is generated at the fixed core 131 and the movable core 132 to generate an electromagnetic force. The fixed core 131 and the movable core 132 form a magnetic path through which a magnetic flux passes. And, an attractive force occurs between the fixed core 131 and the movable core 132 by an electromagnetic force due to a magnetic flux.

The case 140 is formed of a non-magnetic and non-conductive material, and includes upper and lower cases 141 and 142 configured to hermetically cover the fixed contact 110 and the movable contact 120 from the outside, a plunger cap 143 configured to accommodate therein the fixed core 131 and the movable core 132 in a hermetic manner, and a coil cap 144 configured to accommodate therein the coil 134 in a hermetic manner.

Here, the fixed contact 110 may be fixedly-installed at the upper case 141, and the fixed core 131 having a recess for passing the shaft 133 therethrough may be fixedly-installed at the lower case 142.

In a hermetic space formed as the upper case 141 and the lower case 142 are coupled to each other, may be filled gas for extinguishing an arc occurring when the movable contact 120 is separated from the fixed contact 110.

An operation to contact the movable contact 120 to the fixed contact 110 of the electromagnetic switching apparatus will be explained. Once a current is applied to the coil 134, a magnetic field is formed at the periphery of the coil 134, and a magnetic flux is generated at the fixed core 131 and the movable core 132. As a result, an electromagnetic force is generated.

If the coil 134 is wound on the fixed core 131 and the movable core 132 so that facing parts of the fixed core 131 and the movable core 132 can have different polarities, an attractive force is generated. As a result, the movable core 132 is moved toward the fixed core 131. Here, the attractive force should be greater than the gravity.

A driving force is transmitted to the shaft 133 having one side coupled to the movable core 132, and thus the movable contact 120 coupled to another side of the shaft 133 is moved to contact the fixed contact 110.

Once the movable contact 120 comes in contact with the fixed contact 110, the first fixed contact 111 and the second fixed contact 112 are connected to each other by the movable contact 120. Accordingly, power input through the first fixed contact 111 is supplied to a load through the second fixed contact 112.

An operation to separate the movable contact 120 from the fixed contact 110 of the electromagnetic switching apparatus will be explained. Once a current is not applied to the coil 134 in a contact state between the fixed contact 110 and the movable contact 120, a magnetic field formed at the periphery of the coil 134 disappears, and a magnetic flux generated at the fixed core 131 and the movable core 132 also disappears.

As a result, an attractive force between the fixed core 131 and the movable core 132 disappears, and only the gravity is applied to the movable contact 120. Therefore, the movable contact 120 drops by the gravity, and a driving force is transmitted to the shaft 133 having one side coupled to the movable core 132. As a result, the movable contact 120 coupled to another side of the shaft 133 also drops to be separated from the fixed contact 110.

Once the movable contact 120 is separated from the fixed contact 110, the first fixed contact 111 and the second fixed contact 112 are disconnected from each other. Accordingly, power input through the first fixed contact 111 is not supplied to a load through the second fixed contact 112.

However, in the electromagnetic switching apparatus using the shaft of FIG. 1, the movable core and the movable contact are connected to each other by the shaft, and thus the driving force of the movable core driven by an electromagnetic force is transmitted to the movable contact. This may cause the driving unit to have a complicated structure.

SUMMARY OF THE INVENTION

Therefore, an aspect of the detailed description is to provide an electromagnetic switching apparatus capable of having a simplified structure and capable of preventing the occurrence of noise.

To achieve these and other advantages and in accordance with the purpose of this specification, as embodied and broadly described herein, there is provided an electromagnetic switching apparatus comprising a driving unit, the driving unit comprising: a fixed core fixedly-installed so as not to be movable by a magnetic force; a movable core having a lower part installed to face the fixed core, and an upper part coupled to a movable contact; and a coil configured to generate a repulsive force between the fixed core and the movable core by a magnetic force occurring when applying a current thereto, and configured to contact the movable contact to the fixed contact by driving the movable core positioned at an upper side so as to be separated from the fixed core positioned at a lower side, wherein the driving unit is configured to drive the movable contact by an electromagnetic force.

According to another aspect of the present invention, there is provided an electromagnetic switching apparatus, comprising: a fixed contact; a movable contact movable to contact or to be separated from the fixed contact; and a driving unit configured to drive the movable contact by an electromagnetic force, wherein the driving unit comprises: a fixed core fixedly-installed so as not to be movable by a magnetic force; a movable core having a lower part installed to face the fixed core, and an upper part coupled to a movable contact; and a coil configured to generate a repulsive force between the fixed core and the movable core by a magnetic force occurring when applying a current thereto, and configured to contact the movable contact to the fixed contact by driving the movable core positioned at an upper side so as to be separated from the fixed core positioned at a lower side.

In the electromagnetic switching apparatus according to the present invention, the fixed core may be fixedly-installed at a lower side, and the movable core driven by an electromagnetic force may be installed at an upper side so as to be directly connected to the movable contact. This may require no shaft, and thus simplify the entire structure.

In the electromagnetic switching apparatus according to the present invention, contact noise occurring when the movable core moves may be restricted by a noise restriction unit. This may prevent the occurrence of noise.

In the present invention, the electromagnetic switching apparatus may have a simplified structure and may be prevented from generating noise. This may allow the electromagnetic switching apparatus to have an enhanced reliability.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 2:
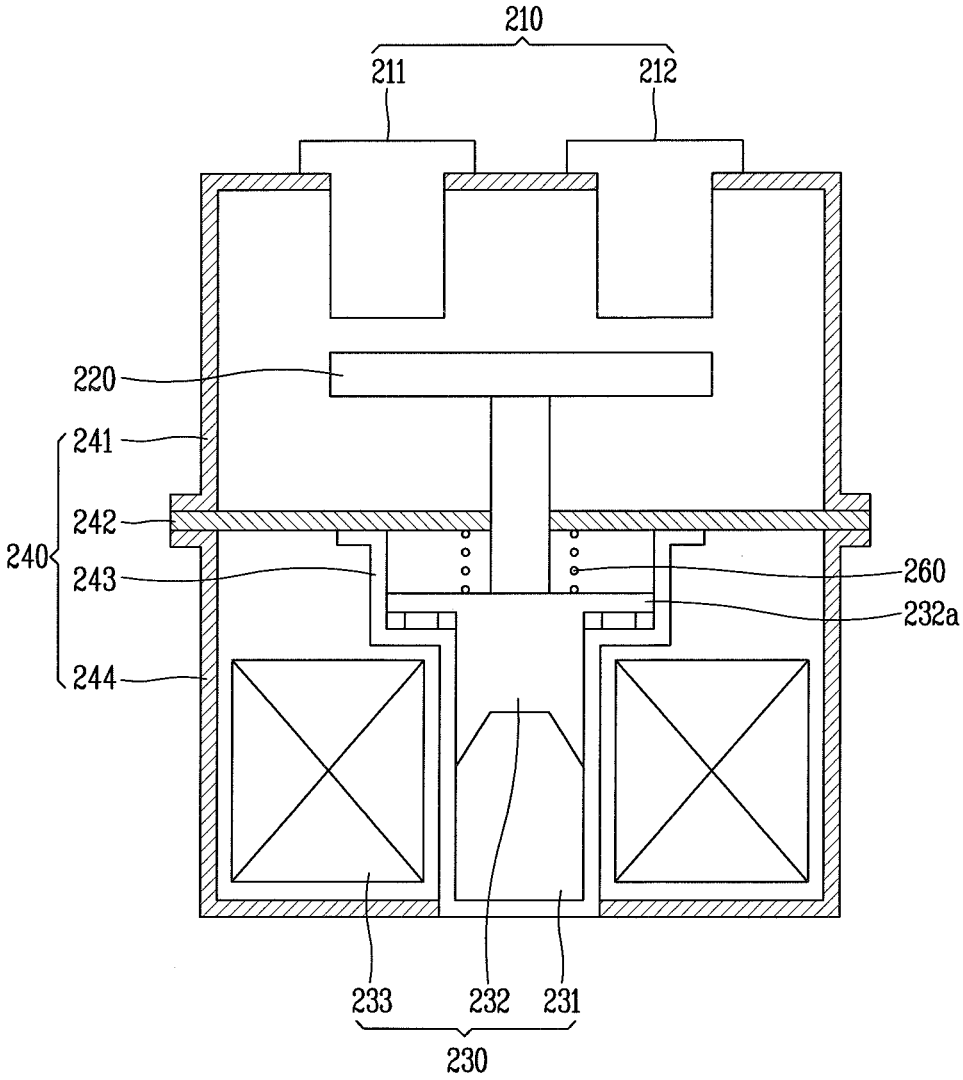
FIG. 2 is a partial sectional view illustrating one example of an electromagnetic switching apparatus using no shaft, which shows a state that a fixed contact and a movable core of the electromagnetic switching apparatus are separated from each other.

FIG. 2 is a partial sectional view illustrating one example of an electromagnetic switching apparatus using no shaft, which shows a state that a fixed contact and a movable core of the electromagnetic switching apparatus are separated from each other. And, FIG. 3 is a partial sectional view illustrating one example of the electromagnetic switching apparatus using no shaft of FIG. 2, which shows a state that the fixed contact and the movable core of the electromagnetic switching apparatus are in a contact state to each other.

Figure 3:
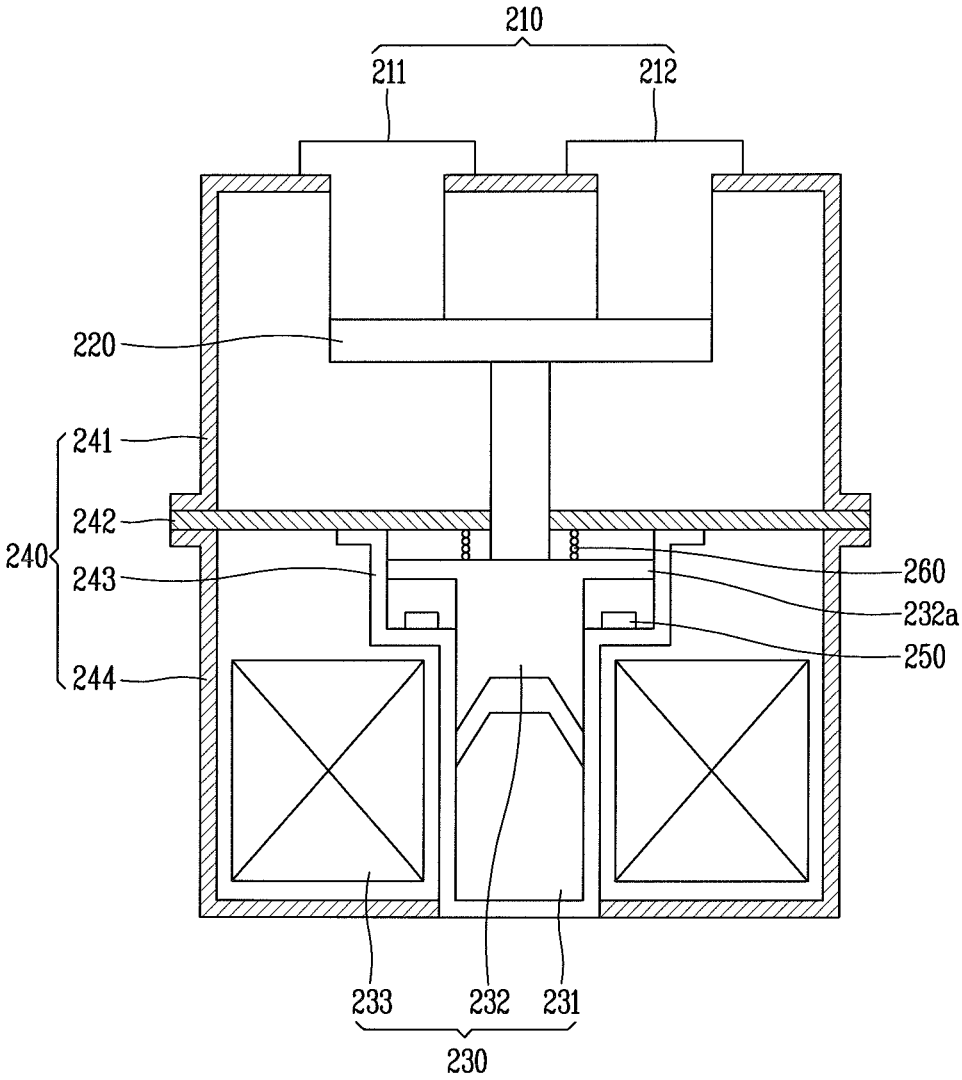
FIG. 3 is a partial sectional view illustrating one example of the electromagnetic switching apparatus using no shaft of FIG. 2, which shows a state that the fixed contact and the movable core of the electromagnetic switching apparatus are in a contact state to each other.

As shown in FIGS. 2 and 3, the electromagnetic switching apparatus 200 according to the present invention comprises a fixed contact 210, a movable contact 220, a driving unit 230 and a case 240.

The fixed contact 210 includes a first fixed contact 211 connected to a power input, and a second fixed contact 212 connected to a load. For instance, the fixed contact 210 may be fixedly-installed at an upper part of the case 240.

The movable contact 220 is configured to contact or to be separated from the fixed contact 210. When the movable contact 220 contacts the fixed contact 210, the first fixed contact 211 and the second fixed contact 212 are connected to each other by the movable contact 220. Accordingly, power input through the first fixed contact 211 is supplied to a load through the second fixed contact 212.

When the movable contact 220 is separated from the fixed contact 210, the first fixed contact 211 and the second fixed contact 212 are disconnected from each other. Accordingly, power input through the first fixed contact 211 is not supplied to a load through the second fixed contact 212.

The driving unit 230 drives the movable contact 220 by using an electromagnetic force, thereby controlling the movable contact 220 to contact or to be separated from the fixed contact 210. The driving unit 230 includes a fixed core 231, a movable core 232 and a coil 233.

The fixed core 231 is fixedly-installed so as not to be movable by an electromagnetic force. Differently from a general electromagnetic switching apparatus, the fixed core 231 is installed below the movable core 232.

The movable core 232 has a lower part installed to face the fixed core 231, and an upper part coupled to the movable contact 220. More concretely, the movable core 232 is installed above the fixed core 231, and is moved by a repulsive force due to an electromagnetic force.

Once a repulsive force occurs between the fixed core 231 and the movable core 232 by an electromagnetic force, the movable core 232 positioned at an upper side is separated from the fixed core positioned at a lower side. However, once the electromagnetic force does not occur any longer, the movable core 232 drops toward the fixed core 131 by gravity.

The coil 232 is configured to generate a repulsive force between the fixed core 231 and the movable core 232 by a magnetic force occurring when applying a current thereto, and configured to contact the movable contact 232 to the fixed contact 210 by driving the movable core 232 positioned at an upper side so as to be separated from the fixed core 231 positioned at a lower side.

More concretely, when a current is applied to the coil 233 installed at the periphery of the fixed core 231 and the movable core 232, a magnetic field is formed at the periphery of the coil 233. By the magnetic field, a magnetic flux is generated at the fixed core 231 and the movable core 232 to generate an electromagnetic force.

The fixed core 231 and the movable core 232 form a magnetic path through which a magnetic flux passes. And, a repulsive force occurs between the fixed core 231 and the movable core 232 by an electromagnetic force due to a magnetic flux.

The case 240 is formed of a non-magnetic and non-conductive material, and includes upper and lower cases 241 and 242 configured to hermetically cover the fixed contact 210 and the movable contact 220 from the outside, a plunger cap 243 configured to accommodate therein the fixed core 231 and the movable core 232 in a hermetic manner, and a coil cap 244 configured to accommodate therein the coil 233 in a hermetic manner.

Here, the fixed contact 210 may be fixedly-installed at the upper case 241, and the fixed core 232 having a recess for passing the movable core 232 having one end coupled to the movable contact 220 therethrough may be formed at the lower case 242.

In a hermetic space formed as the upper case 241 and the lower case 242 are coupled to each other, may be filled gas for extinguishing an arc occurring when the movable contact 220 is separated from the fixed contact 210.

An operation to contact the movable contact 220 to the fixed contact 210 of the electromagnetic switching apparatus will be explained. Once a current is applied to the coil 233, a magnetic field is formed at the periphery of the coil 233, and a magnetic flux is generated at the fixed core 231 and the movable core 232. As a result, an electromagnetic force is generated.

If the coil 233 is wound on the fixed core 231 and the movable core 232 so that facing parts of the fixed core 231 and the movable core 232 to each other can have the same polarity, a repulsive force is generated. As a result, the movable core 232 positioned at an upper side is separated from the fixed core 231 positioned at a lower side. Here, the repulsive attractive force should be greater than the gravity.

The movable contact 220 coupled to another side of the movable core 232 is moved to contact the fixed contact 210. Once the movable contact 220 comes in contact with the fixed contact 210, the first fixed contact 211 and the second fixed contact 212 are connected to each other by the movable contact 220. Accordingly, power input through the first fixed contact 211 is supplied to a load through the second fixed contact 212.

An operation to separate the movable contact 220 from the fixed contact 210 of the electromagnetic switching apparatus will be explained. Once a current is not applied to the coil 233 in a contact state between the fixed contact 210 and the movable contact 220, a magnetic field formed at the periphery of the coil 233 disappears, and a magnetic flux generated at the fixed core 231 and the movable core 232 also disappears.

As a result, the repulsive force between the fixed core 231 and the movable core 232 disappears, and only the gravity is applied to the movable contact 220. Therefore, the movable contact 220 drops by the gravity, and thus the movable contact 220 coupled to one side of the movable core 232 is separated from the fixed contact 210.

Once the movable contact 220 is separated from the fixed contact 210, the first fixed contact 211 and the second fixed contact 212 are disconnected from each other. Accordingly, power input through the first fixed contact 211 is not supplied to a load through the second fixed contact 212.

Figure 1:
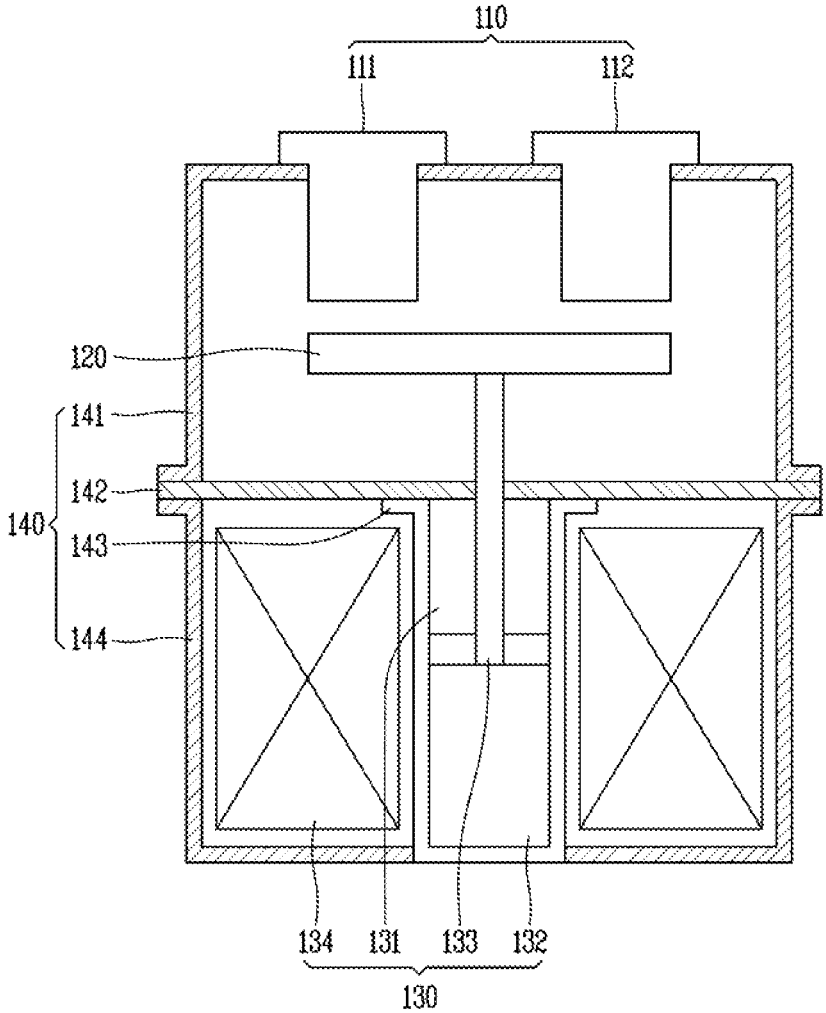
FIG. 1 PRIOR ART
FIG. 1 is a partial sectional view illustrating one example of an electromagnetic switching apparatus using a shaft.

In the electromagnetic switching apparatus according to the present invention, differently from the electromagnetic switching apparatus of FIG. 1, a shaft for connecting the movable core and the movable contact to each other is not used, and installation positions of the fixed core and the movable core are changed. And, the movable contact is directly connected to the movable core, such that a driving force of the movable core driven by an electromagnetic force is directly transmitted to the movable contact. This may simplify the structure of the driving unit, and minimize the size of the apparatus.

In the present invention, the movable core 232 may include a motion restriction unit 232*a*. The motion restriction unit 232*a* is configured to restrict a motion of the movable core 232.

For instance, the motion restriction unit 232*a* may be formed by protruding an intermediate part of the movable core 232. Accordingly, when the movable core 232 is upwardly moved through the recess formed at the lower case 242 by a repulsive force between the fixed core 231 and the movable core 232 occurring by an electromagnetic force, the motion restriction unit 232*a* formed by protruding an intermediate part of the movable core 232 restricts a motion of the movable core 232.

Under this configuration, a drastic impact occurring when the movable contact 220 coupled to one end of the movable core 232 contacts the fixed contact 210 may be restricted. This may prevent the fixed contact 210 or the movable contact 220 from being damaged, resulting in providing an electromagnetic switching apparatus having an enhanced reliability.

In the present invention, the electromagnetic switching apparatus 200 may further comprise a noise restriction unit 250. The noise restriction unit 250 comes in contact with a lower part of the motion restriction unit 232*a*, thereby restricting noise occurring by the motion restriction unit 232*a* when the movable core 232 moves.

For instance, an upper part of the plunger cap 243 configured to accommodate the fixed core 231 and the movable core 232 therein in a hermetic manner is extended in correspondence to a shape of the motion restriction unit 232*a*. Then, the noise restriction unit 250 formed of a material capable of restricting noise by attenuating an impact is installed between the motion restriction unit 232*a* and the extended part of the plunger cap 243. Under this configuration, noise occurring by the motion restriction unit 232*a* when the movable core 232 moves may be prevented by the noise restriction unit 250. This may provide an electromagnetic switching apparatus having an enhanced reliability.

In the present invention, the electromagnetic switching apparatus 200 may further comprise a repulsion spring 260. The repulsion spring 260 is inserted into an upper part of the motion restriction unit 232*a*, thereby providing a repulsive force to the movable core 232.

For instance, the repulsion spring 260 is installed between the motion restriction unit 232*a* protruding from an intermediate part of the movable core 232, and the lower case 242. Under this configuration, when the movable core 232 upwardly moves by a repulsive force, the repulsion spring 260 operates to separate the motion restriction unit 232*a* from the lower case 242. This may reduce a drastic impact occurring when the movable contact 220 coupled to one end of the movable core 232 comes in contact with the fixed contact 210. As a result, the fixed contact 210 or the movable contact 220 may be prevented from being damaged.

Furthermore, a current is not applied to the coil 233 in a state that the movable contact 220 is in contact with the fixed contact 210. This may cause the repulsive force between the fixed core 231 and the movable core 232 due to an electromagnetic force to disappear. As a result, the movable contact 220 may be separated from the fixed contact 210 more rapidly by the repulsive spring 260 as the repulsion spring 260 operates. This may stabilize the electromagnetic switching apparatus.

In the present invention, an upper part of the movable core 232 coupled to the movable contact 220 may have a narrower sectional surface than a lower part of the movable core 232 facing the fixed core 231.

The fixed contact 210 and the movable contact 220 are accommodated in a space hermetically formed by the upper case 241 and the lower case 242, and the movable core 232 is driven through the recess formed at the lower case 242. In order to enhance a sealed state of the space formed by the upper case 241 and the lower case 242, it is advantageous to form the recess in a smaller size, the recess through which the movable core passes.

On the contrary, the lower part of the movable core 232 facing the fixed core 231 has to have a large sectional surface so as to form a sufficient magnetic flux density. In order to satisfy the above two conditions, the upper part of the movable core 232 coupled to the movable contact 220 is implemented to have a narrower sectional surface than the lower part of the movable core 232 facing the fixed core 231. This may allow the electromagnetic switching apparatus to be more stabilized.

In the present invention, an upper part of the fixed core 231 facing the movable core 232 may be partially cut to form a first shape, and a lower part of the movable core 232 facing the fixed core 231 may be partially cut to form a second shape.

For instance, the upper part of the fixed core 231 undergoes embossed carving in a cylindrical shape having a narrow upper surface and a wide lower surface, thereby implementing a first shape. And, the lower part of the movable core 232 undergoes depressed engraving (intaglio) in a cylindrical shape having a narrow upper surface and a wide lower surface, thereby implementing a second shape. This may increase a repulsive force between the fixed core 231 and the movable core 232 by changing a magnetic force distribution.

A magnetic flux density is a value proportional to the number of lines of magnetic force passing per unitary area perpendicular to a magnetic flux direction, and inversely proportional to an area. And, a magnetic force is a value proportional to a magnetic flux density. Accordingly, once a contact area between the fixed core 231 and the movable core 232 is decreased, the magnetic flux density and the magnetic force are increased and the repulsive force between the fixed core 231 and the movable core 232 is increased. This may provide an electromagnetic switching apparatus having an enhanced reliability.

As aforementioned, in the present invention, the fixed core is fixedly-installed at a lower part of the electromagnetic switching apparatus, and the movable core driven by an electromagnetic force is installed at an upper part of the electromagnetic switching apparatus so as to be directly connected to the movable contact. This may require no shaft to simplify the entire structure. In the present invention, contact noise occurring when the movable core moves may be restricted by the noise restriction unit. This may prevent the occurrence of noise. This may provide an electromagnetic switching apparatus having an enhanced reliability.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A driving unit of an electromagnetic switching apparatus, the driving unit comprising:

a fixed core positioned at a lower side of the driving unit and fixedly-installed such that the fixed core is not movable by an electromagnetic force;

a movable core positioned at an upper side of the driving unit and having a lower portion that faces the fixed core and an upper portion that is directly fixed to a movable contact;

a coil that is configured to:

generate a first repulsive force between the fixed core and the movable core by using the electromagnetic force, the electromagnetic force generated when a current is applied to the coil, and drive the moveable core by using the electromagnetic force such that the movable contact contacts a fixed contact of the driving unit when the movable core is separated from the fixed core; and an upper case and a lower case, the upper and lower cases forming a space that hermetically encloses the fixed contact and the movable contact, wherein the upper portion of the movable core has a smaller cross-sectional surface area than the lower portion of the movable core, wherein the lower case forms an opening through which the upper portion of the movable core passes, and wherein an upper portion of the fixed core faces the lower portion of the movable core, and the upper portion of the fixed core is partially cut to form a first shape.

2. The electromagnetic switching apparatus of claim 1, wherein the movable core comprises a motion-restricting unit configured to restrict motion of the moveable core.

3. The electromagnetic switching apparatus of claim 2, wherein the motion-restricting unit is formed by a protruding intermediate portion of the movable core.

4. The electromagnetic switching apparatus of claim 3, further comprising a noise-restricting unit configured to contact a lower portion of the motion-restricting unit and to restrict noise generated by the motion-restricting unit when the movable core moves.

5. The electromagnetic switching apparatus of claim 3, further comprising a repulsion spring that is inserted into an upper portion of the motion-restricting unit and is configured to exert a second repulsive force on the movable core.

6. The electromagnetic switching apparatus of claim claim 1, wherein the lower portion of the movable core facing the upper portion of the fixed core is partially cut to form a second shape.

7. An electromagnetic switching apparatus comprising:

a fixed contact;

a movable contact configured to contact the fixed contact and to separate from the fixed contact; and a driving unit configured to drive the movable contact by using an electromagnetic force, the driving unit comprising:

a fixed core positioned at a lower side of the driving unit and fixedly-installed such that the fixed core is not movable by the electromagnetic force;

a movable core positioned at an upper side of the driving unit and having a lower portion that faces the fixed core and an upper portion that is directly fixed to the movable contact; and a coil configured to:

generate a first repulsive force between the fixed core and the movable core by using the electromagnetic force, the electromagnetic force generated when a current is applied to the coil, and drive the movable core by using the electromagnetic force such that the movable contact contacts the fixed contact when the moveable core is separated from the fixed core; and an upper case and a lower case, the upper and lower cases forming a space that hermetically encloses the fixed contact and the movable contact, wherein the upper portion of the movable core has a smaller cross-sectional surface area than the lower portion of the movable core, and wherein the lower case forms an opening through which the upper portion of the movable core passes, wherein an upper portion of the fixed core faces the lower portion of the movable core, and the upper portion of the fixed core is partially cut to form a first shape, and the lower portion of the movable core facing the upper portion of the fixed core is partially cut to form a second shape.

8. The electromagnetic switching apparatus of claim 7, wherein the movable core comprises a motion restricting unit configured to restrict motion of the moveable core.

9. The electromagnetic switching apparatus of claim 8, wherein the motion-restricting unit is formed by a protruding intermediate portion of the movable core.

10. The electromagnetic switching apparatus of claim 9, further comprising a noise-restricting unit configured to contact a lower portion of the motion-restricting unit and to restrict noise generated by the motion-restricting unit when the movable core moves.

11. The electromagnetic switching apparatus of claim 9, further comprising a repulsion spring that is inserted into an upper portion of the motion-restricting unit and is configured to exert a second repulsive force on the movable core.

12. An electromagnetic switching apparatus comprising:

a driving unit comprising:

a fixed contact, a movable contact configured to contact the fixed contact and to separate from the fixed contact, a fixed core positioned at a lower side of the driving unit and fixedly-installed such that the fixed core is not movable by an electromagnetic force, a movable core positioned at an upper side of the driving unit and having a motion-restricting unit that is configured to restrict motion of the moveable core, the moveable core having a lower portion that faces the fixed core and further having an upper portion that is directly fixed to the movable contact, and a coil configured to:

generate a first repulsive force between the fixed core and the movable core by using the electromagnetic force, the electromagnetic force generated when a current is applied to the coil, and drive the moveable core by using the electromagnetic force such that the movable contact contacts the fixed contact when the moveable core is separated from the fixed core;

a noise-restricting unit configured to contact a lower portion of the motion-restricting unit and to restrict noise generated by the motion-restricting unit when the movable core moves;

a repulsion spring that is inserted into an upper portion of the motion-restricting unit and is configured to exert a second repulsive force on the movable core; and an upper case and a lower case, the upper and lower cases forming a space that hermetically encloses the fixed contact and the movable contact, wherein the upper portion of the movable core has a smaller cross-sectional surface area than the lower portion of the movable core, and wherein the lower case forms an opening through which the upper portion of the movable core passes, wherein an upper portion of the fixed core faces the lower portion of the movable core, and the upper portion of the fixed core is partially cut to form a first shape, and wherein the lower portion of the movable core facing the upper portion of the fixed core is partially cut to form a second shape.

13. The electromagnetic switching apparatus of claim 12, wherein the motion-restricting unit is formed by a protruding intermediate portion of the movable core.

* * * * *